US010210820B2

(12) United States Patent
Inamura

(10) Patent No.: US 10,210,820 B2
(45) Date of Patent: Feb. 19, 2019

(54) IMAGE DISPLAY APPARATUS AND METHOD FOR CONTROLLING SAME

(71) Applicant: CANON KABUSHIKI KAISHA, Tokyo (JP)

(72) Inventor: Kohei Inamura, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 52 days.

(21) Appl. No.: 15/423,076

(22) Filed: Feb. 2, 2017

(65) Prior Publication Data

US 2017/0221426 A1 Aug. 3, 2017

(30) Foreign Application Priority Data

Feb. 3, 2016 (JP) ..... 2016-019241
Dec. 20, 2016 (JP) ..... 2016-246599

(51) Int. Cl.
*G09G 3/34* (2006.01)
*G09G 3/36* (2006.01)

(52) U.S. Cl.
CPC ..... *G09G 3/3413* (2013.01); *G09G 3/3426* (2013.01); *G09G 3/3607* (2013.01); *G09G 2320/0242* (2013.01); *G09G 2320/0646* (2013.01)

(58) Field of Classification Search
CPC ... G09G 2320/0242; G09G 2320/0646; G09G 2360/147; G09G 3/3413; G09G 3/3426; G09G 3/3607; G09G 5/10; G09G 3/3688; G02F 1/133617
See application file for complete search history.

(56) References Cited

U.S. PATENT DOCUMENTS

2010/0117948 A1* 5/2010 Hiramatsu ..... G09G 3/3426 345/102
2012/0274882 A1* 11/2012 Jung ..... G02F 1/133617 349/96
2013/0257919 A1* 10/2013 Kimura ..... G09G 5/10 345/690
2017/0018231 A1* 1/2017 Liu ..... G09G 3/3688
2017/0242301 A1* 8/2017 Wan ..... G09G 3/3426

FOREIGN PATENT DOCUMENTS

JP 2002-099250 A 4/2002
JP 2012-022028 A 2/2012
JP 2016-510909 A 4/2016

* cited by examiner

*Primary Examiner* — Richard J Hong
(74) *Attorney, Agent, or Firm* — Cowan, Liebowitz & Latman, P.C.

(57) ABSTRACT

An image display apparatus according to the present invention includes: a light-emitting unit including a plurality of light sources and a conversion member; a display unit configured to display an image by modulating light from the light-emitting unit; a control unit configured to control respective light-emitting brightness of the plurality of light sources; an estimation unit configured to estimate, based on the respective light-emitting brightness, a first brightness distribution and a second brightness distribution; and an image processing unit configured to perform image processing, in which color unevenness due to a difference between the first brightness distribution and the second brightness distribution is reduced, to input image data.

20 Claims, 7 Drawing Sheets

IMAGE DISPLAY APPARATUS AND METHOD FOR CONTROLLING SAME

BACKGROUND OF THE INVENTION

Field of the Invention

The present invention relates to an image display apparatus and a method for controlling the same.

Description of the Related Art

There are fine particles known by the name of quantum dots. Quantum dots are semiconductor fine particles having a size (particle diameter) of several nm to several tens of nm. In a case where light is irradiated to the quantum dots, the quantum dots are excited and emit light. The wavelength of the light emitted from the quantum dots depends on the size of the quantum dots, which means that by controlling the size of the quantum dots, it is possible to obtain light having a high-purity color. The "light having a high-purity color" can in other words be expressed as "light having a sharp peak spectrum." In this regard, a liquid-crystal display apparatus using quantum dots has been proposed (Japanese Patent Application Laid-open No. 2012-22028). A liquid-crystal display apparatus is an image display apparatus having a backlight module and a liquid-crystal panel. The liquid-crystal display apparatus disclosed in Japanese Patent Application Laid-open No. 2012-22028 uses a conversion member that includes quantum dots. The conversion member emits a part of light from the light sources of the backlight module to the liquid-crystal panel through converting same using the quantum dots, and emits a part of the light from the light sources without converting same.

In the backlight module of a liquid-crystal display apparatus, a plurality of light sources, which respectively correspond to a plurality of divided areas constituting an area of a screen, may be used. In relation to such a backlight module, the technique of local dimming control has been known (Japanese Patent Application Laid-open No. 2002-99250). In local dimming control, the light-emitting brightness of the plurality of light sources is individually controlled. The light-emitting brightness of the respective light sources is controlled based on, for example, input image data. Specifically, the light-emitting brightness of light sources corresponding to divided areas in which the input image data is dark is reduced to low light-emitting brightness. Further, in a case where the local dimming control is performed, image processing based on the light-emitting brightness of the respective light sources may be performed to the input image data.

However, in the above liquid-crystal display apparatus having the conversion member, color unevenness occurs in light from the conversion member due to the local dimming control. As a result, color unevenness occurs in a screen (color display unevenness).

SUMMARY OF THE INVENTION

The present invention provides a technology capable of reducing color display unevenness due to local dimming control in an image display apparatus having a conversion member.

The present invention in its first aspect provides an image display apparatus comprising:

a light-emitting unit including a plurality of light sources, each of which emits light having a first color, and a conversion member that converts a part of the light having the first color emitted from the respective light sources into light having a second color and emits light including the light having the first color and the light having the second color;

a display unit configured to display an image on a screen by modulating, based on image data, the light including the light having the first color and the light having the second color emitted from the light-emitting unit;

a control unit configured to individually control respective light-emitting brightness of the plurality of light sources based on input image data;

an estimation unit configured to estimate, based on the respective light-emitting brightness of the plurality of light sources, a first brightness distribution which is a brightness distribution of combined light obtained by combining the light having the first color emitted from the light-emitting unit and a second brightness distribution which is a brightness distribution of combined light obtained by combining the light having the second color emitted from the light-emitting unit; and an image processing unit configured to perform image processing, in which color unevenness in the screen due to a difference between the first brightness distribution and the second brightness distribution is reduced based on the first brightness distribution and the second brightness distribution, to the input image data, and to output image data to which the image processing having been performed to the display unit.

The present invention in its second aspect provides a method for controlling an image display apparatus having:

a light-emitting unit including a plurality of light sources, each of which emits light having a first color, and a conversion member that converts a part of the light having the first color emitted from the respective light sources into light having a second color and emits light including the light having the first color and the light having the second color; and a display unit configured to display an image on a screen by modulating, based on image data, the light including the light having the first color and the light having the second color emitted from the light-emitting unit, the method comprising:

a control step of individually controlling respective light-emitting brightness of the plurality of light sources based on input image data;

an estimation step of estimating, based on the respective light-emitting brightness of the plurality of light sources, a first brightness distribution which is a brightness distribution of combined light obtained by combining the light having the first color emitted from the light-emitting unit and a second brightness distribution which is a brightness distribution of combined light obtained by combining the light having the second color emitted from the light-emitting unit; and an image processing step performing image processing, in which color unevenness in the screen due to a difference between the first brightness distribution and the second brightness distribution is reduced based on the first brightness distribution and the second brightness distribution, to the input image data, and outputting image data to which the image processing having been performed to the display unit.

The present invention in its third aspect provides a non-transitory computer readable medium that stores a program, wherein the program causes a computer to execute a method for controlling an image display apparatus having:

a light-emitting unit including a plurality of light sources, each of which emits light having a first color, and a conversion member that converts a part of the light having the first color emitted from the respective light sources into light having a second color and emits light including the light having the first color and the light having the second color; and a display unit configured to display an image on a screen by modulating, based on image data, the light including the light having the first color and the light having the second color emitted from the light-emitting unit, and the method includes:

a control step of individually controlling respective light-emitting brightness of the plurality of light sources based on input image data;

an estimation step of estimating, based on the respective light-emitting brightness of the plurality of light sources, a first brightness distribution which is a brightness distribution of combined light obtained by combining the light having the first color emitted from the light-emitting unit and a second brightness distribution which is a brightness distribution of combined light obtained by combining the light having the second color emitted from the light-emitting unit; and an image processing step performing image processing, in which color unevenness in the screen due to a difference between the first brightness distribution and the second brightness distribution is reduced based on the first brightness distribution and the second brightness distribution, to the input image data, and outputting image data to which the image processing having been performed to the display unit.

The present invention in its fourth aspect provides an image display apparatus comprising:

a light-emitting unit including a plurality of light sources, each of which emits light having a first color, and a conversion member that converts a part of the light having the first color emitted from the respective light sources into light having a second color and emits light including the light having the first color and the light having the second color;

a display unit configured to display an image on a screen by modulating, based on image data, the light including the light having the first color and the light having the second color emitted from the light-emitting unit;

a control unit configured to individually control respective light-emitting brightness of the plurality of light sources based on input image data;

an estimation unit configured to estimate, based on the respective light-emitting brightness of the plurality of light sources, a first brightness distribution which is a brightness distribution of the light having the first color emitted from the light-emitting unit, and a third brightness distribution which is a difference between the first brightness distribution and a second brightness distribution which is a brightness distribution of the light having the second color emitted from the light-emitting unit; and an image processing unit configured to perform image processing, in which color unevenness in the screen due to a difference between the first brightness distribution and the second brightness distribution is reduced based on the first brightness distribution and the third brightness distribution, to the input image data, and to output image data to which the image processing having been performed to the display unit.

The present invention in its fifth aspect provides an image display apparatus comprising:

a light-emitting unit including a plurality of light sources, each of which emits light having a first color, and a conversion member that converts a part of the light having the first color emitted from the respective light sources into light having a second color and emits light including the light having the first color and the light having the second color;

a display unit configured to display an image on a screen by modulating, based on image data, the light including the light having the first color and the light having the second color emitted from the light-emitting unit;

a control unit configured to individually control respective light-emitting brightness of the plurality of light sources based on input image data; and an image processing unit configured to perform image processing in which color unevenness in the screen due to a difference in brightness ratio of the light having the first color to the light having the second color between a vicinity of a first light source and a vicinity of a second light source is reduced in a case where light-emitting brightness of the first light source and light-emitting brightness of the second light source are different from each other, to the input image data, and to output image data to which the image processing having been performed to the display unit.

According to an embodiment of the present invention, it is possible to reduce color display unevenness due to local dimming control in an image display apparatus having a conversion member.

Further features of the present invention will become apparent from the following description of exemplary embodiments with reference to the attached drawings.

DESCRIPTION OF THE EMBODIMENTS

Hereinafter, a description will be given of an embodiment of the present invention. Note that although the following example describes a case in which an image display apparatus according to the embodiment is a transmission liquid-crystal display apparatus, the image display apparatus according to the embodiment is not limited to the transmission liquid-crystal display apparatus. The image display apparatus according to the embodiment needs only to be an image display apparatus that displays an image on a screen by modulating light based on image data. For example, the image display apparatus according to the embodiment may be a micro electro mechanical system (MEMS) shutter display apparatus using a MEMS shutter as a display element.

Figure 1:
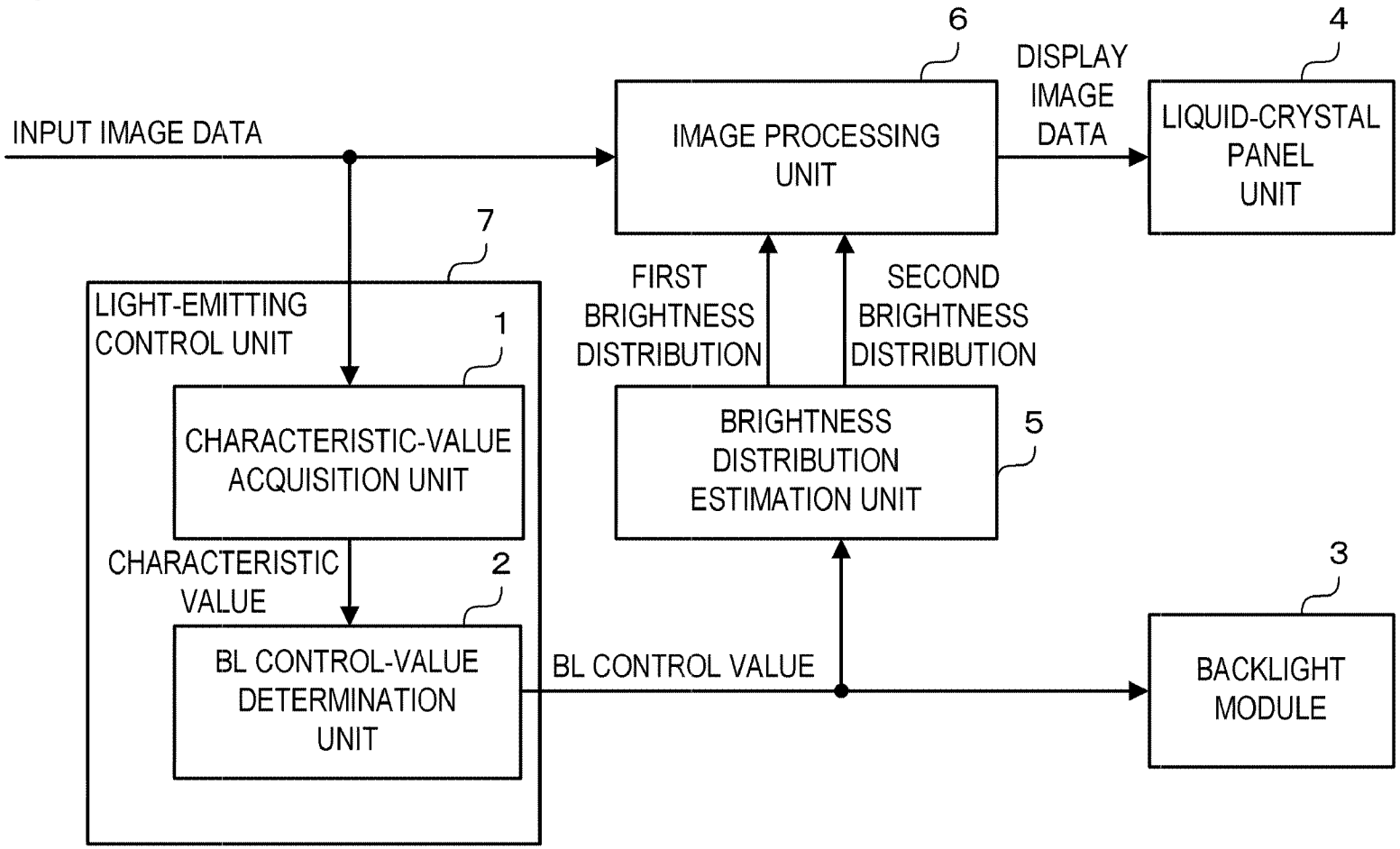
FIG. 1 is a block diagram showing an example of the function configuration of an image display apparatus according to an embodiment.

FIG. 1 is a block diagram showing an example of the function configuration of the image display apparatus according to the embodiment. The image display apparatus according to the embodiment has a backlight module 3, a liquid-crystal panel unit 4, a brightness distribution estimation unit 5, an image processing unit 6, and a light-emitting control unit 7. Note that each of the brightness distribution estimation unit 5, the image processing unit 6, and the light-emitting control unit 7 may be or may not be separate hardware. The functions of two or more function units may be implemented by common hardware.

Figure 2:
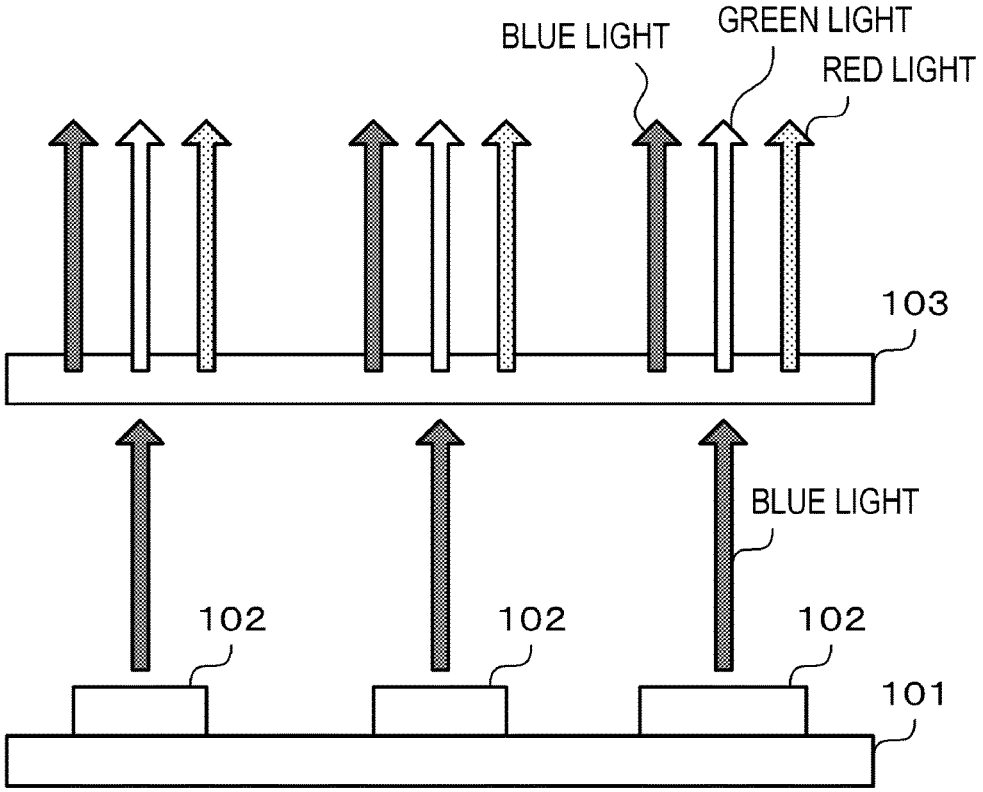
FIG. 2 is a diagram showing a configuration example of a backlight module according to the embodiment.

The backlight module 3 is a light-emitting unit that emits light onto the back surface of the liquid-crystal panel unit 4. FIG. 2 is a diagram showing a configuration example of the backlight module 3. In the example of FIG. 2, the backlight module 3 has a substrate 101, a plurality of light sources 102, and a conversion member 103.

The configuration of the substrate 101 is not particularly limited, but a reflection plate having high light reflectance is, for example, used as the substrate 101. The plurality of light sources 102 is provided on the substrate 101. Each of the plurality of light sources 102 is a light source that emits the light having a first color. The first color is not particularly limited, but blue is used as the first color in the embodiment. The light-emitting brightness of the respective light sources 102 may be individually controlled. The respective light sources 102 have one or more light-emitting elements. As the light-emitting elements, light-emitting diodes, organic EL elements, plasma elements, cold cathode ray tube elements, or the like may be used. The light (the light having blue; blue light) emitted from the respective light sources 102 is incident on the conversion member 103.

The conversion member 103 converts a part of the blue light emitted from the respective light sources 102 into the light having a second color, and emits light including the blue light and the light having the second color. In the embodiment, the main wavelength of the light having the second color is longer than that of the blue light. Specifically, the conversion member 103 emits a part of the blue light emitted from the respective light sources 102 through converting the same into red light (the light having red), and emits a part of the blue light emitted from the respective light sources 102 through converting the same into green light (the light having green). Further, the conversion member 103 emits a part of the blue light emitted from the respective light sources 102 with converting the same or without converting the same. In the embodiment, red or green is used as the second color. The light emitted from the conversion member 103 is irradiated onto the back surface of the liquid-crystal panel unit 4. For example, the red light, the green light, and the blue light are emitted from the conversion member 103, and white light (the light having white) obtained by combining the emitted light together is irradiated onto the back surface of the liquid-crystal panel unit 4.

In the embodiment, the conversion member 103 has quantum dots (R quantum dots) that convert the blue light into the red light and quantum dots (G quantum dots) that convert the blue light into the green light. In a case where the blue light is irradiated to the R quantum dots, the R quantum dots are excited to generate the red light. In a case where the blue light is irradiated to the G quantum dots, the G quantum dots are excited to generate the green light. In addition, in the embodiment, the conversion member 103 is a sheet-shaped member. Therefore, the conversion member 103 may be called a "quantum dot sheet."

Note that a method for converting the light with the conversion member 103 is not particularly limited. For example, a phosphor different from the quantum dots may be used to convert the light. Moreover, the light obtained by the conversion with the conversion member 103 is not limited to the red light and the green light. That is, the second color is not limited to the red or the green. For example, as the light having the second color, light having a main wavelength shorter than that of the light having the first color may be used. Furthermore, the conversion member 103 is not limited to the sheet-shaped member. For example, as the conversion member 103, a plate-shaped member having a certain degree of thickness may be used.

The description of FIG. 1 will be given again. The light-emitting control unit 7 individually controls the light-emitting brightness of the respective light sources 102 based on input image data (image data input to the image display apparatus). In the embodiment, the light-emitting control unit 7 has a characteristic-value acquisition unit 1 and a BL control-value determination unit 2. Note that each of the characteristic-value acquisition unit 1 and the BL control-value determination unit 2 may be or may not be separate hardware. The functions of the characteristic-value acquisition unit 1 and the BL control-value determination unit 2 may be implemented by common hardware.

The characteristic-value acquisition unit 1 acquires characteristic values from the input image data. In the embodiment, the respective light sources 102 correspond to some areas (partial areas) of a screen. In the embodiment, the areas of the screen are constituted by a plurality of divided areas corresponding to the plurality of light sources 102, respectively. For each of the plurality of divided areas, the characteristic-value acquisition unit 1 acquires a characteristic value from image data (a part of the input image data) corresponding to the divided area. In the embodiment, the maximum values of pixel values (maximum pixel values) of the image data corresponding to the divided areas are acquired as the characteristic values.

Note that the characteristic values are not limited to the maximum pixel values. For example, as the characteristic values, other representative values (average values, minimum values, intermediate values, modes, or the like) of the pixel values may be acquired as the characteristic values. As the characteristic values, the histogram of the pixel values may be acquired. As the characteristic values, the representative values of brightness values, the histogram of the brightness values, or the like may be acquired.

Note that the partial areas are not limited to the divided areas. The partial areas may be separated from other partial areas, or at least some of the partial areas may be overlapped with at least some of other partial areas. The partial areas and the light sources 102 may not have a one-to-one relationship. For example, two or more light sources 102 may correspond to one partial area.

The BL control-value determination unit 2 individually determines BL control values for the respective light sources 102 based on the characteristic values acquired by the characteristic-value acquisition unit 1. A method for determining the BL control values is not particularly limited. However, in the embodiment, for each of the plurality of light sources 102, the BL control-value determination unit 2 determines a BL control value for the light source 102 according to the characteristic value acquired for the divided area corresponding to the light source 102. Then, the BL control-value determination unit 2 outputs the BL control values for the respective light sources 102 to the backlight module 3. The BL control values are values corresponding to the light-emitting brightness of the light sources 102. Therefore, it may be said that "processing to determine the BL control values" is equivalent to "processing to determine the light-emitting brightness." By the input of the BL control values to the backlight module 3, the light-emitting brightness of the light sources 102 is controlled to light-emitting brightness corresponding to the BL control values. Therefore, it may be said that "processing to output the BL control values to the backlight module 3" is equivalent to "processing to control the light-emitting brightness of the light sources 102." For example, the BL control-value determination unit 2 determines the BL control values such that the light-emitting brightness of the light sources 102 is controlled to lower light-emitting brightness as the maximum pixel values are lower. The BL control-value determination unit 2 may also determine BL control values with which the light sources 102 are turned off.

As described above, in the embodiment, local dimming control for individually controlling the light-emitting brightness of the respective light sources 102 is performed. However, in a case in which the backlight module 3 has the configuration as shown in FIG. 2, color unevenness occurs in light from the backlight module 3 due to the local dimming control. As a result, color unevenness (color display unevenness) occurs in the screen.

Figure 3A:
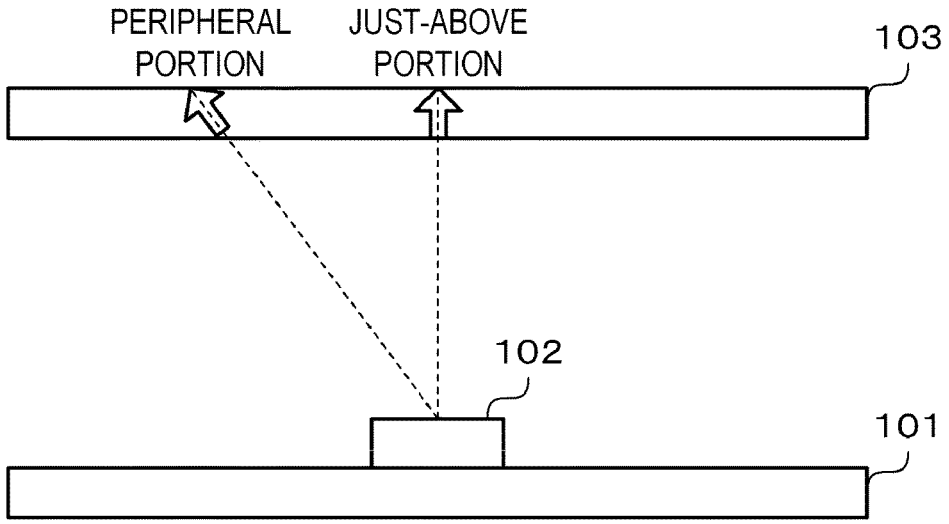
FIGS. 3A and 3B are diagrams each showing an example of the light path of light emitted from a light source according to the embodiment.

FIG. 3A shows an example of the light path of the light emitted from one of the light sources 102. As shown in FIG. 3A, the peripheral portion of the light source 102 is longer in distance until the blue light from the light source 102 passes through the conversion member 103 than the just-above portion of the light source 102. With an increase in the distance until the blue light passes through the conversion member 103, a light amount of the blue light converted into the red light and a light amount of the blue light converted into the green light increase while a blue-light amount ratio reduces. Accordingly, a blue brightness ratio is smaller in the peripheral portion of the light source 102 than the just-above portion of the light source 102. The blue brightness ratio is the ratio of the brightness of the blue light emitted from the backlight module 3 to the brightness of the red light (or the green light) emitted from the backlight module 3. In FIG. 3A, the "light emitted from the backlight module 3" is the "light emitted from the conversion member 103."

Figure 3B:
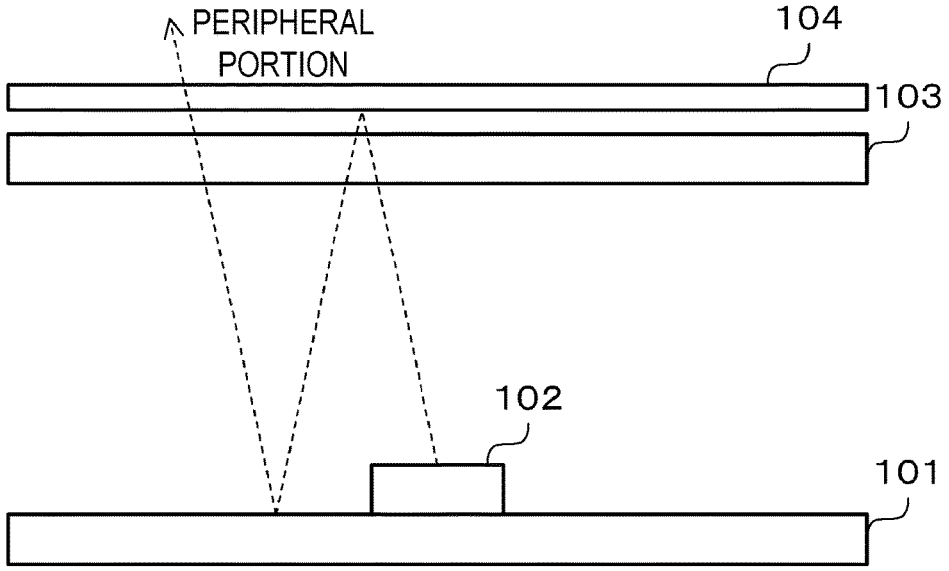

FIG. 3B shows another example of the light path of the light emitted from the light source 102. As shown in FIG. 3B, a polarization reflection plate 104 may be arranged under the liquid-crystal panel unit 4 (on the back surface side of the liquid-crystal panel unit 4; on the upper side of the conversion member 103) to increase the use efficiency of the blue light from the light source 102. According to this configuration, the light emitted from the backlight module 3 includes light, which has passed through the conversion member 103 many times after being reflected by the polarization reflection plate 104 and the substrate (reflection plate) 101, at the peripheral portion of the light source 102. Further, with an increase in the number of times at which the light has passed through the conversion member 103, the blue brightness ratio reduces. In FIG. 3B, the "light emitted from the backlight module 3" is the "light emitted from the polarization reflection plate 104."

Figure 4:
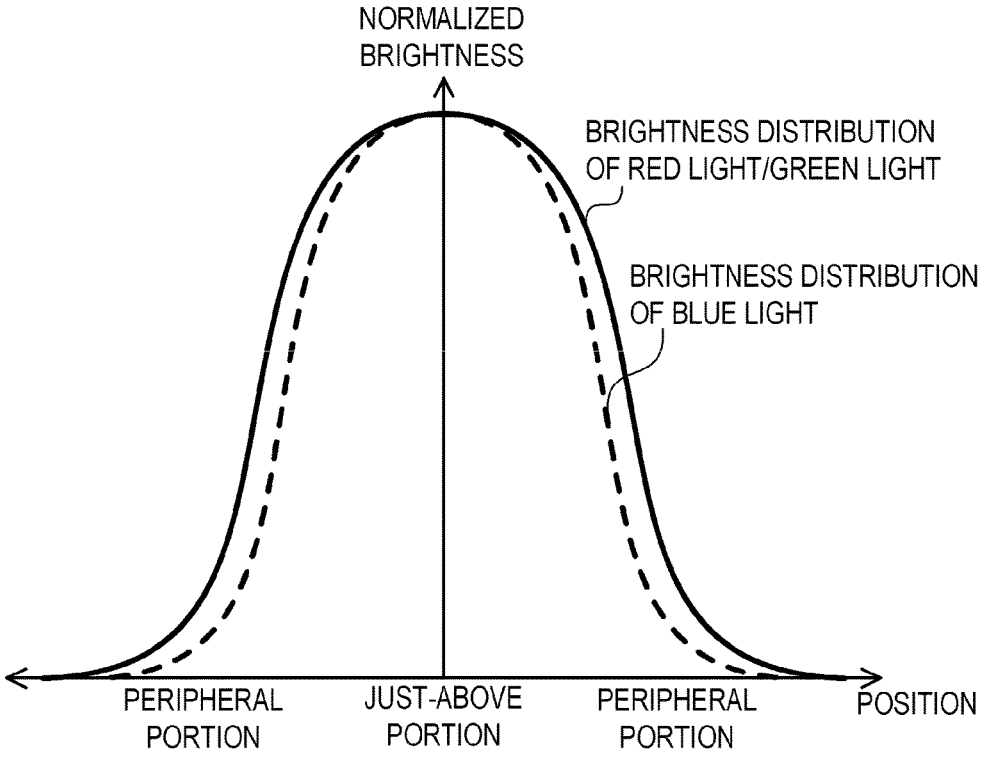
FIG. 4 is a diagram showing an example of brightness distributions according to the embodiment.

As described above, in a case where only one of the light sources 102 lights up, the blue brightness ratio varies. In other words, in a case where only one of the light sources 102 lights up, the brightness distribution of the red light (or the green light) emitted from the backlight module 3 is made different from the brightness distribution of the blue light emitted from the backlight module 3. FIG. 4 shows an example of the brightness distributions. A vertical axis in FIG. 4 represents normalized brightness in which the brightness of the light emitted from the backlight module 3 is normalized so as to make its maximum value set at a predetermined value. A horizontal axis in FIG. 4 represents a position on the light-emitting surface of the backlight module 3. In FIG. 4, a solid line represents the brightness distribution of the red light (or the green light), and dashed lines represent the brightness distribution of the blue light. It appears from FIG. 4 that the brightness distribution of the red light (or the green light) is different from the brightness distribution of the blue light. In addition, it appears that the blue brightness ratio (the ratio of the brightness of the dashed lines to the brightness of the solid line) varies. In other words, in a case where the blue brightness ratio varies, color unevenness occurs in the light from the backlight module 3.

Figure 5A:
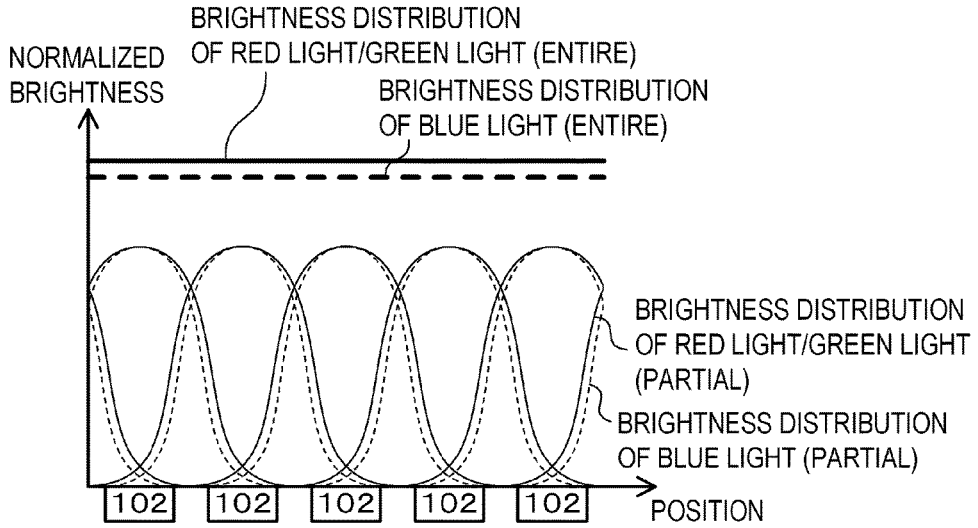
FIGS. 5A to 5C are diagrams each showing an example of the brightness distributions according to the embodiment.
Figure 5B:
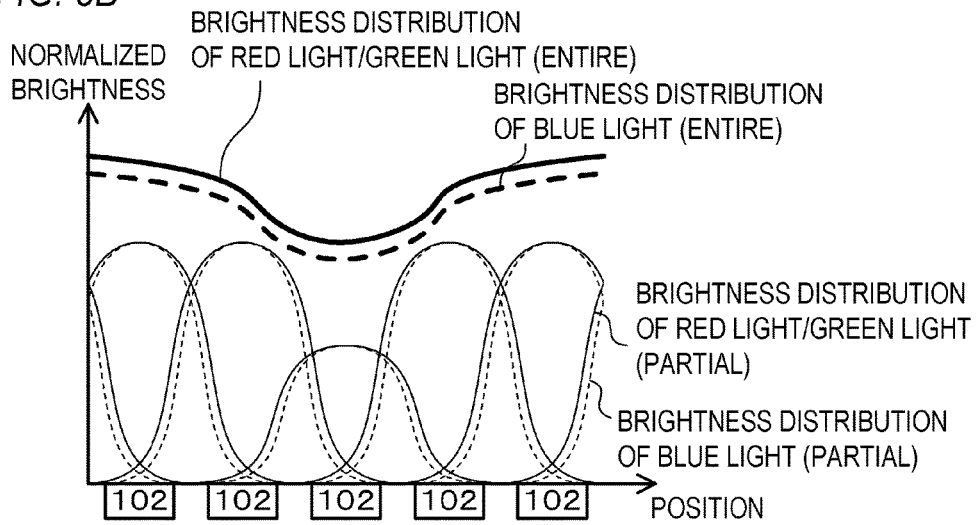

FIGS. 5A and 5B show an example of the brightness distributions of the light emitted from the backlight module 3. Like the vertical axis in FIG. 4, a vertical axis in FIGS. 5A and 5B represents the normalized brightness of the light emitted from the backlight module 3. Like the horizontal axis in FIG. 4, a horizontal axis in FIGS. 5A and 5B represents a position on the light-emitting surface. Thin solid lines in FIGS. 5A and 5B represent the brightness distributions of the red light (or the green light) in a case where only one of the light sources 102 lights up, and thin dashed lines in FIGS. 5A and 5B represent the brightness distributions of the blue light in a case where only one of the light sources 102 lights up. Further, thick solid lines in FIGS. 5A and 5B represent the brightness distributions of the red light (or the green light) in a case where all the light sources 102 light up, and thick dashed lines in FIGS. 5A and 5B represent the brightness distributions of the blue light in a case where all the light sources 102 light up. The brightness distributions of the thick solid lines are brightness distributions obtained by combining the plurality of brightness distributions of the thin solid lines together, and the brightness distributions of the thick dashed lines are brightness distributions obtained by combining the plurality of brightness distributions of the thin dashed lines together. In FIGS. 5A and 5B, the light sources 102 are shown in corresponding positions.

In FIG. 5A, the light-emitting brightness of the respective light sources 102 is controlled to the same light-emitting brightness. It appears from FIG. 5A that both the brightness distribution of the thick solid line and the brightness distribution of the thick dashed lines are constant and the blue brightness ratio (the ratio of the brightness of the thick dashed lines to the brightness of the thick solid line) does not vary. That is, it appears from FIG. 5A that color unevenness does not occur in the light from the backlight module 3. Specifically, the blue light is weaker than the red light and the green light over the entire light-emitting surface. Therefore, the light having a color close to yellow is obtained as the light from the light-emitting surface over the entire light-emitting surface, and partial color unevenness does not occur.

On the other hand, in FIG. 5B, the light-emitting brightness of one of the light sources 102 is controlled to light-emitting brightness lower than the light-emitting brightness of the rest of the light sources 102. That is, the local dimming control is performed in FIG. 5B. It appears from FIG. 5B that the brightness reduces in the vicinity of the light source having the lower light-emitting brightness in both the brightness distribution of the thick solid line and the brightness distribution of the thick dashed lines. Further, it also appears that the blue brightness ratio (the ratio of the brightness of the thick dashed lines to the brightness of the thick solid line) is made different between an area in the vicinity of the light source having the lower light-emitting brightness and the rest areas. That is, it appears from FIG. 5B that color unevenness occurs in the light from the backlight module 3. Specifically, the blue light is particularly weaker than the red light and the green light in the vicinity of the light source having the lower light-emitting brightness. Therefore, the light having a color closer to yellow than the light from the light-emitting surfaces in the rest areas is obtained as the light from the light-emitting surface in the vicinity of the light source having the lower light-emitting brightness, which results in the occurrence of partial color unevenness.

Figure 5C:
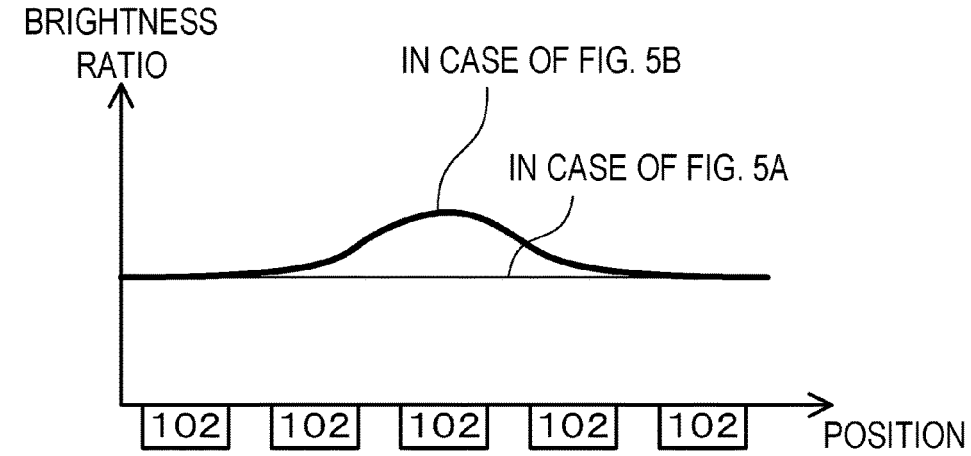

FIG. 5C shows the distributions of the brightness ratios between the brightness of the red light or the green light (the thick solid lines in FIGS. 5A and 5B) and the brightness of the blue light (the thick dashed lines in FIGS. 5A and 5B). A vertical axis in FIG. 5C represents the reciprocal of the blue brightness ratio (the ratio of the brightness of the red light (or the green light) to the brightness of the blue light) as the brightness ratio. A horizontal axis in FIG. 5C is the same as the horizontal axis in FIGS. 5A and 5B. A thin solid line in FIG. 5C represents a brightness ratio obtained from the brightness distributions in FIG. 5A, and a thick solid line in FIG. 5C represents a brightness ratio obtained from the brightness distributions in FIG. 5B. It also appears from FIG. 5C that the brightness ratio is constant in the case of FIG. 5A and color unevenness does not occur in the light from the backlight module 3. Further, it appears that the brightness ratio is not constant in the case of FIG. 5B and color unevenness occurs in the light from the backlight module 3.

As described above, in a case where the conversion member 103 is used, color unevenness occurs in the light from the backlight module 3 due to the local dimming control. As a result, color display unevenness occurs. Since conventional image processing performed with the local dimming control does not consider the above phenomenon occurring with the use of the conversion member 103, it is not possible to reduce the above color display unevenness. In view of this problem, the embodiment performs image processing in consideration of the above phenomenon to reduce the above color display unevenness.

The description of FIG. 1 will be given again. The brightness distribution estimation unit 5 estimates the brightness distributions of the light emitted from the backlight module 3 based on the light-emitting brightness of the respective light sources 102 (BL control values output from the BL control-value determination unit 2). The brightness distribution estimation unit 5 estimates the brightness distributions in a case where the light-emitting brightness of the respective light sources 102 is controlled to light-emitting brightness corresponding to the BL control values output from the BL control-value determination unit 2. The brightness distribution estimation unit 5 estimates a first brightness distribution as the brightness distribution of the blue light and a second brightness distribution as the brightness distribution of the red light (or the green light).

Based on the first brightness distribution and the second brightness distribution estimated by the brightness distribution estimation unit 5, the image processing unit 6 performs image processing (unevenness reduction processing), in which color display unevenness due to the difference between the first brightness distribution and the second brightness distribution is reduced, to input image data. Then, the image processing unit 6 outputs display image data which is image data after the unevenness reduction processing is performed to the liquid-crystal panel unit 4. Note that the image processing to generate the display image data needs only to include the unevenness reduction processing but may further include other image processing. For example, as image processing different from the unevenness reduction processing, brightness adjustment processing, color adjustment processing, blurring processing, edge enhancement processing, or the like may be further performed.

The liquid-crystal panel unit 4 is a display unit that displays an image on the screen by modulating (transmitting) the light from the backlight module 3 based on the display image data. Specifically, the liquid-crystal panel unit 4 has a liquid-crystal panel with a plurality of liquid-crystal elements, a liquid-crystal driver that drives the respective liquid-crystal elements, and a control substrate that controls the processing of the liquid-crystal driver according to the display image data.

The processing method of the brightness distribution estimation unit 5 (method for estimating the brightness distributions) is not particularly limited, but the embodiment estimates the brightness distributions according to the following method. In the embodiment, for the light source 102, a first reference distribution which is the brightness distribution of the blue light emitted from the backlight module 3 in a case where the light-emitting brightness of the light source 102 is controlled to predetermined light-emitting brightness is set in advance. In addition, for the light source 102, a second reference distribution which is the brightness distribution of the red light (or the green light) emitted from the backlight module 3 in a case where the light-emitting brightness of the light source 102 is controlled to the predetermined light-emitting brightness is set in advance. In the embodiment, first information on the first reference distribution (first diffusion profile) and second information on the second reference distribution (second diffusion profile) are stored in advance in the brightness distribution estimation unit 5. Specifically, a first table representing the first reference distribution is stored in advance in the brightness distribution estimation unit 5 as the first information, and a second table representing the second reference distribution is stored in advance in the brightness distribution estimation unit 5 as the second information. The first table is a table showing the correspondence relationship between a distance from the light sources 102 and the brightness of the blue light emitted from the backlight module 3. The second table is a table showing the correspondence relationship between a distance from the light sources 102 and the brightness of the red light (or the green light) emitted from the backlight module 3.

In the embodiment, the brightness distribution estimation unit 5 estimates the first brightness distribution based on the light-emitting brightness (BL control values) of the respective light sources 102 determined by the BL control-value determination unit 2 and the first reference distribution (first information; first table). Specifically, for the respective light sources 102, the brightness distribution estimation unit 5 estimates first partial distributions based on the light-emitting brightness determined by the BL control-value determination unit 2 about the light sources 102 and the first reference distribution. The first partial distribution is the brightness distribution of the blue light emitted from the backlight module 3 in a case where the light-emitting brightness of the light source 102 is controlled to light-emitting brightness determined by the BL control-value determination unit 2. The first partial distributions are brightness distributions like those represented by the thin dashed lines in FIGS. 5A and 5B. Further, the brightness distribution estimation unit 5 estimates the first brightness distribution by combining the first partial distributions of the respective light sources 102 together. The first brightness distribution is a brightness distribution like those represented by the thick dashed lines in FIGS. 5A and 5B.

In addition, in the embodiment, the brightness distribution estimation unit 5 estimates the second brightness distribution based on the light-emitting brightness (BL control values) of the respective light sources 102 determined by the BL control-value determination unit 2 and the second reference distribution (second information; second table). Specifically, for the respective light sources 102, the brightness distribution estimation unit 5 estimates second partial distributions based on the light-emitting brightness determined by the BL control-value determination unit 2 about the light sources 102 and the second reference distribution. The second partial distribution is the brightness distribution of the red light (or the green light) emitted from the backlight module 3 in a case where the light-emitting brightness of the light source 102 is controlled to the light-emitting brightness determined by the BL control-value determination unit 2. The second partial distributions are brightness distributions like those represented by the thin solid lines in FIGS. 5A and 5B. Further, the brightness distribution estimation unit 5 estimates the second brightness distribution by combining the second partial distributions of the respective light sources 102 together. The second brightness distribution is a brightness distribution like those represented by the thick solid lines in FIGS. 5A and 5B.

Note that the first reference distribution and the second reference distribution may be or may not be brightness distributions in a case in which only one of the light sources 102 lights up. For example, the first reference distribution and the second reference distribution may be brightness distributions in a case in which one of the light sources 102 lights up at predetermined light-emitting brightness and at least another of the light sources 102 lights up at extremely low light-emitting brightness. Similarly, the first partial distributions and the second partial distributions may be or may not be brightness distributions in a case in which only one of the light sources 102 lights up. In addition, the predetermined light-emitting brightness is not particularly limited. The predetermined light-emitting brightness is, for example, the light-emitting brightness of the respective light sources 102 in a case in which an image display is performed in a display mode in which the respective light sources 102 light up at the same light-emitting brightness.

Note that a storage unit different from the brightness distribution estimation unit 5 may store at least one of the first information and the second information, and the brightness distribution estimation unit 5 may read at least one of the first information and the second information from the storage unit and use the same. The storage unit that stores at least one of the first information and the second information may be a storage unit included in the image display apparatus, or may be a storage unit attachable/detachable to/from the image display apparatus.

Note that the first information and the second information may be any information so long as it is possible to grasp the first brightness distribution and the second brightness distribution from the first information and the second information, respectively. For example, as the first information, a function representing the correspondence relationship between a distance from the light sources 102 and the brightness of the blue light emitted from the backlight module 3 may be used instead of the first table. Further, as the second information, a function representing the correspondence relationship between a distance from the light sources 102 and the brightness of the red light (or the green light) emitted from the backlight module 3 may be used instead of the second table. With the use of the functions as information instead of the tables, it is possible to reduce an information data size. In addition, as one of the first information and the second information, information representing the difference between the first reference distribution and the second reference distribution (differential information) may be used instead of information representing the brightness distributions. With the use of the differential information instead of the information representing the brightness distributions, it is possible to reduce an information data size.

Note that as the first reference distribution, one brightness distribution common between the plurality of light sources 102 may be set in advance or a plurality of brightness distributions corresponding to the plurality of light sources 102, respectively, may be set in advance. As the second reference distribution, one brightness distribution common between the plurality of light sources 102 may be set in advance or a plurality of brightness distributions corresponding to the plurality of light sources 102, respectively, may be set in advance.

Here, consideration is given to a case in which a plurality of first reference distributions corresponding to the plurality of light sources 102, respectively, is set in advance. In this case, as the first information representing the first reference distributions, a table or a function representing the correspondence relationship between a position within the light-emitting surface of the backlight module 3 and the brightness of the blue light emitted from the backlight module 3 may be used. Next, consideration is given to a case in which a plurality of second reference distributions corresponding to the plurality of light sources 102, respectively, is set in advance. In this case, as the second information representing the second reference distributions, a table or a function representing the correspondence relationship between a position within the light-emitting surface of the backlight module 3 and the brightness of the red light (or the green light) emitted from the backlight module 3 may be used.

Next, a description will be given of a specific example of the processing of the image processing unit 6. In a case where the local dimming control is performed, the image processing unit 6 performs, for example, image processing (brightness compensation processing) to expand image data by an amount corresponding to a reduction in the brightness of the light from the backlight module 3. Thus, it is possible to realize a display at brightness at which the image data before being expanded is displayed. The above color display unevenness occurring with the local dimming of the image display apparatus having the conversion member 103 results from the difference between the first brightness distribution and the second brightness distribution estimated by the brightness distribution estimation unit 5. Therefore, in the embodiment, the image processing unit 6 considers the first brightness distribution and the second brightness distribution in the above brightness compensation processing. Thus, the image processing unit 6 may perform the unevenness reduction processing to reduce the color display unevenness as the above brightness compensation processing. As a result, the image display apparatus can display an image in which the color display unevenness is reduced.

In the embodiment, the following processing (one of first processing and second processing) is performed as the unevenness reduction processing. In the following description, it is assumed that the respective pixel values of the input image data include first gradation values corresponding to the first color and second gradation values corresponding to the second color. In addition, the liquid-crystal panel unit 4 has, as liquid-crystal elements corresponding to one pixel, first elements corresponding to the first color and second elements corresponding to the second color. Specifically, it is assumed that the respective pixel values of the input image data are RGB values (combination of R values, G values, and B values). The R values are gradation values corresponding to red, the G values are gradation values corresponding to green, and the B values are gradation values corresponding to blue. In the embodiment, the B values are the first gradation values, and the R values or the G values are the second gradation values. Further, it is assumed that the liquid-crystal panel unit 4 has, as liquid-crystal elements corresponding to one pixel, R elements corresponding to the red, G elements corresponding to the green, and B elements corresponding to the blue. Note that the method of the unevenness reduction processing is not particularly limited so long as the method is based on the first brightness distribution and the second brightness distribution. In addition, the data format of the input image data is not particularly limited.

(First Processing)

The first processing is preferably performed in a case where transmittance at which the light having an unsupported color passes through the liquid-crystal elements of the liquid-crystal panel unit 4 is sufficiently low. Specifically, the first processing is preferably performed in a case where transmittance at which the green light and the blue light pass through the R elements, transmittance at which the red light and the blue light pass through the G elements, and transmittance at which the red light and the green light pass through the B elements are sufficiently low. In the first processing, the respective first gradation values of the input image data are corrected based on the first brightness distribution, and the respective second gradation values of the input image data are corrected based on the second brightness distribution. Specifically, the image processing unit 6 determines correction values with which the respective R values and the G values of the input image data are corrected based on the second brightness distribution, and determines correction values with which the respective B values of the input image data are corrected based on the first brightness distribution.

Figure 6A:
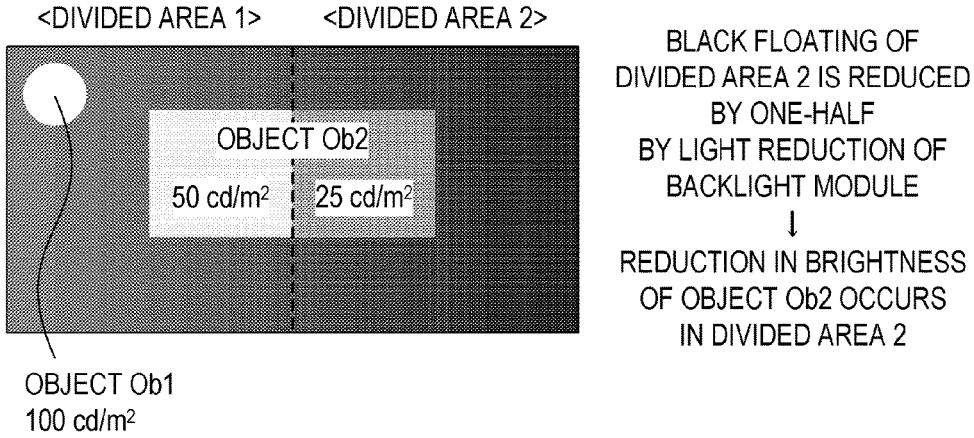
FIGS. 6A to 6C are diagrams each showing an example of the brightness distributions according to the embodiment.

FIG. 6A is an image diagram of a screen example in a case in which a reduction in the brightness of an object Ob2 is not compensated in a divided area 2 in a case where an image in which an object Ob1 and the object Ob2 exist on a black background is displayed in a divided area 1 and the divided area 2. Since characteristic values (maximum pixel values) acquired from the divided area 2 are smaller than characteristic values (maximum pixel values) acquired from the divided area 1, the light-emitting brightness of the light sources in the divided area 2 is lower than the light-emitting brightness of the light sources in the divided area 1. Therefore, in the case in which the reduction in the brightness of the object Ob2 is not compensated in the divided area 2, the display brightness of the object Ob2 is made different between the divided area 1 and the divided area 2.

Figure 6B:
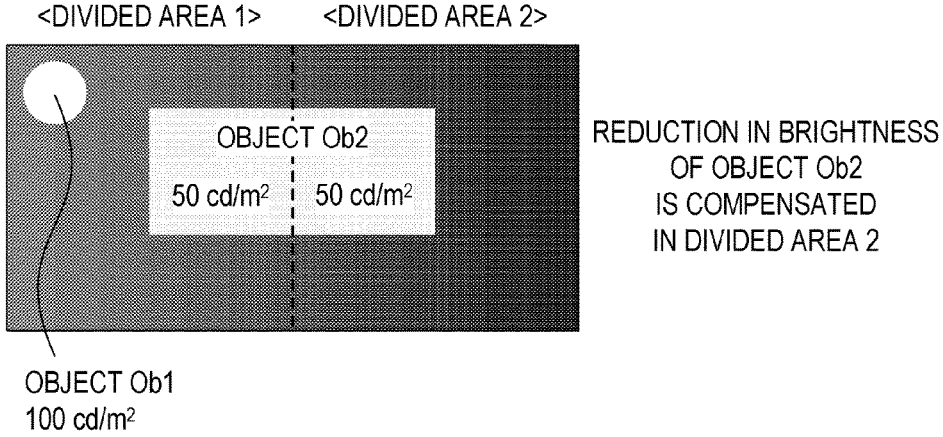
Figure 6C:
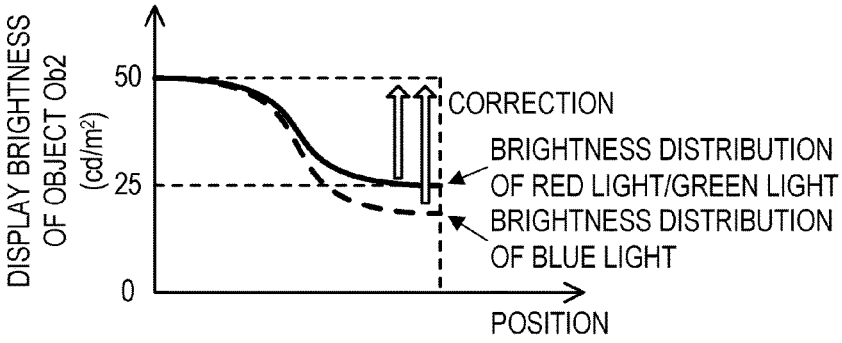

FIG. 6B is an image diagram of a screen example in a case in which the reduction in the brightness of the object Ob2 is compensated in the divided area 2 in a case where the image in which the objects Ob1 and Ob2 exist on the black background is displayed in the divided areas 1 and 2. FIG. 6C is a diagram for describing correction processing to correct image data to compensate for the reduction in the brightness of the object Ob2 in the divided area 2. The characteristic-value acquisition unit 1 acquires the maximum values of pixel values (maximum pixel values) as the characteristic values of the image data corresponding to the respective divided areas 1 and 2, and the BL control-value determination unit 2 determines the respective BL control values of the divided areas 1 and 2. In a case where it is assumed that the display brightness of the object Ob1 is 100 cd/m$^2$ and the display brightness of the object Ob2 is 50 cd/m$^2$ in the divided area 1, the display brightness of the object Ob1 becomes 100 cd/m$^2$ and the display brightness of the object Ob2 becomes 25 cd/m$^2$ in the divided area 2. The brightness distribution estimation unit 5 estimates the first brightness distribution of combined light obtained by combining the blue light emitted from the two light sources of the divided areas 1 and 2 and then emitted from the backlight module 3 together. In addition, the brightness distribution estimation unit 5 estimates the second brightness distribution of combined light obtained by combining the red light/the green light emitted from the two light sources of the divided areas 1 and 2 and then emitted from the backlight module 3 together. Then, the image processing unit 6 determines correction values with which the respective R values, the G values, and the B values of the input image data are corrected to compensate for the reduction in the display brightness of the object Ob2 in the divided area 2. The correction amounts of the B values are greater than the correction amounts of the R values and the G values.

Then, the image processing unit 6 corrects the respective RGB values of the input image data using the determined correction values. Thus, in a case in which transmittance at which the light having an unsupported color passes through the liquid-crystal elements of the liquid-crystal panel unit 4 is sufficiently low, it is possible to obtain desired brightness (for example, brightness represented by the input image data) as display brightness (screen brightness) and reduce color display unevenness.

(Second Processing)

The second processing is preferably performed in a case where transmittance at which the light having an unsupported color passes through the liquid-crystal elements of the liquid-crystal panel unit 4 is not sufficiently low. In the second processing, the respective first gradation values of the input image data are corrected based on the first brightness distribution and the second brightness distribution, and the respective second gradation values of the input image data are corrected based on the first brightness distribution and the second brightness distribution. In a general liquid-crystal panel, the light having an unsupported color slightly passes through liquid-crystal elements. In the second processing, the respective pixel values of the input image data are corrected in consideration of such transmittance.

The correspondence relationship between the RGB values (R value, G value, B value)=($R_t$, $G_t$, $B_t$) of the input image data and XYZ tristimulus values (X value, Y value, Z value)=($X_t$, $Y_t$, $Z_t$) corresponding to the RGB ($R_t$, $G_t$, $B_t$) values may be represented by the following formula 1.

[Math. 1]

$$\begin{pmatrix} X_t \\ Y_t \\ Z_t \end{pmatrix} = (L_R \times M_R + L_G \times M_G + L_B \times M_B) \begin{pmatrix} R_t \\ G_t \\ B_t \end{pmatrix} \quad \text{(formula 1)}$$

In the above formula 1, "$L_R$" is the reference brightness of the red light emitted from the backlight module 3, "$L_G$" is the reference brightness of the green light emitted from the backlight module 3, and "Le" is the reference brightness of the blue light emitted from the backlight module 3. Further, "$M_R$," "$M_G$," and "$M_B$" are the matrices of three rows and three columns with which the RGB values are converted into the XYZ tristimulus values. Specifically, the matrix $M_R$ is a matrix with which the XYZ tristimulus values of the light obtained in a case where the red light passes through the R elements, the G elements, and the B elements are obtained from the reference brightness $L_R$ and the RGB values ($R_t$, $G_t$, $B_t$). The matrix $M_G$ is a matrix with which the XYZ tristimulus values of the light obtained in a case where the green light passes through the R elements, the G elements, and the B elements are obtained from the reference brightness $L_G$ and the RGB values ($R_t$, $G_t$, $B_t$). The matrix $M_B$ is a matrix with which the XYZ tristimulus values of the light obtained in a case where the blue light passes through the R elements, the G elements, and the B elements are obtained from the reference brightness $L_B$ and the RGB values ($R_t$, $G_t$, $B_t$). The reference brightness $L_R$, $L_G$, and $L_B$ are not particularly limited, for example, the reference brightness $L_R$, $L_G$, and $L_B$ are brightness obtained in a case where all the light sources 102 light up at the above predetermined light-emitting brightness. The reference brightness $L_R$, $L_G$, and $L_B$ and the matrices $M_R$, $M_G$, and $M_B$ are set in advance.

Here, it is assumed that due to the local dimming control, the brightness of the red light emitted from the backlight module 3 is changed to brightness k times the reference brightness $L_R$ and the brightness of the green light emitted from the backlight module 3 is changed to brightness k times the reference brightness $L_G$. Further, it is assumed that the brightness of the blue light emitted from the backlight module 3 is changed to brightness m times the reference brightness $L_B$. For example, "k" and "m" are values of 1 or less and different from each other. In this case, the correspondence relationship between the RGB values ($R_t'$, $G_t'$, $B_t'$) after the second processing and the XYZ tristimulus values ($X_t$, $Y_t$, $Z_t$) may be represented by the following formula 2.

[Math. 2]

$$\begin{pmatrix} X_t \\ Y_t \\ Z_t \end{pmatrix} = (k \times L_R \times M_R + k \times L_G \times M_G + m \times L_B \times M_B) \begin{pmatrix} R_t' \\ G_t' \\ B_t' \end{pmatrix} \quad \text{(formula 2)}$$

From the above formulae 1 and 2, the following formula 3 is obtained as a formula representing the correspondence relationship between the RGB values ($R_t$, $G_t$, $B_t$) of the input image data and the RGB values ($R_t'$, $G_t'$, $B_t'$) after the second processing.

[Math. 3]

$$\begin{pmatrix} R_t' \\ G_t' \\ B_t' \end{pmatrix} = (k \times L_R \times M_R + k \times L_G \times M_G + m \times L_B \times M_B)^{-1} \quad \text{(formula 3)}$$

$$(L_R \times M_R + L_G \times M_G + L_B \times M_B) \begin{pmatrix} R_t \\ G_t \\ B_t \end{pmatrix}$$

The image processing unit 6 calculates magnifications k and m based on the first brightness distribution, the second brightness distribution, at least one of the reference brightness $L_R$ and the reference brightness $L_G$, and the reference brightness $L_B$ and corrects the RGB values using the above formula 3. The magnification k may be calculated from the first brightness distribution estimated by the brightness distribution estimation unit 5 and the reference brightness $L_R$ (or the reference brightness $L_G$). For example, the ratio of brightness represented by the first brightness distribution to the reference brightness $L_R$ may be calculated as the magnification k. Similarly, the magnification m may be calculated from the first brightness distribution estimated by the brightness distribution estimation unit 5 and the reference brightness $L_B$. For example, the ratio of brightness represented by the first brightness distribution to the reference brightness $L_B$ may be calculated as the magnification m. The magnification k by which the reference brightness $L_R$ is multiplied and the magnification k by which the reference brightness $L_G$ is multiplied may be individually calculated. For example, the ratio of brightness represented by the second brightness distribution to the reference brightness $L_R$ may be calculated as the magnification k by which the reference brightness $L_R$ is multiplied. Further, the ratio of brightness represented by the second brightness distribution to the reference brightness $L_G$ may be calculated as the magnification k by which the reference brightness $L_G$ is multiplied.

As described above, according to the embodiment, the first brightness distribution and the second brightness distribution are estimated and taken into consideration in the image processing. Thus, in the image display apparatus having the conversion member, color display unevenness due to the local dimming control can be reduced.

Note that as other embodiments of the above first processing, third information on a third reference distribution which is the difference between the first reference distribution and the second reference distribution may be stored in the brightness distribution estimation unit 5 in advance. Specifically, the first information on the first reference distribution and the above third information may be stored in the brightness distribution estimation unit 5 in advance. In this case, the second information on the second reference distribution may not be stored in the brightness distribution estimation unit 5 in advance. As described above, the first reference distribution is the brightness distribution of the blue light emitted from the backlight module 3 in a case where the light-emitting brightness of the light source 102 is controlled to predetermined light-emitting brightness. Further, the second reference distribution is the brightness distribution of the red light (or the green light) emitted from the backlight module 3 in a case where the light-emitting brightness of the light source 102 is controlled to the predetermined light-emitting brightness. The third information is, for example, a third table representing the third reference distribution.

In this case, the brightness distribution estimation unit 5 estimates the first brightness distribution based on the light-emitting brightness (BL control values) of the respective light sources 102 determined by the BL control-value determination unit 2 and the first reference distribution (first information; first table). The first brightness distribution is the brightness distribution of combined light obtained by combining the blue light emitted from the respective light sources and then emitted from the backlight module 3 together. In addition, the brightness distribution estimation unit 5 estimates the third brightness distribution based on the light-emitting brightness (BL control values) of the respective light sources 102 determined by the BL control-value determination unit 2 and the third reference distribution (third information; third table). The third brightness distribution is a brightness distribution corresponding to the difference between the combined light obtained by combining the blue light emitted from the respective light sources and then emitted from the backlight module 3 together and combined light obtained by combining the red light (or the green light) emitted from the respective light sources and then emitted from the backlight module 3 together. Further, the image processing unit 6 determines correction values with which the respective R values, the G values, and the B values of the input image data are corrected based on the first brightness distribution, and corrects correction values with which the respective R values and the G values of the input image data are corrected based on the third brightness distribution. It is not necessary to correct correction values with which the respective B values of the input image data are corrected based on the third brightness distribution. Then, the image processing unit 6 corrects the respective RGB values of the input image data using the determined correction values.

In addition, the second information on the second reference distribution and the third information may be stored in the brightness distribution estimation unit 5 in advance. In this case, the first information on the first reference distribution may not be stored in the brightness distribution estimation unit 5 in advance.

In this case, the brightness distribution estimation unit 5 estimates the second brightness distribution based on the light-emitting brightness (BL control values) of the respective light sources 102 determined by the BL control-value determination unit 2 and the second reference distribution (second information; second table). The second brightness distribution is the brightness distribution of combined light obtained by combining the red light (or the green light) emitted from the respective light sources and then emitted from the backlight module 3 together. In addition, the brightness distribution estimation unit 5 estimates the third brightness distribution based on the light-emitting brightness of the respective light sources 102 determined by the BL control-value determination unit 2 and the third reference distribution. Further, the image processing unit 6 determines correction values with which the respective R values, the G values, and the B values of the input image data are corrected based on the second brightness distribution and corrects correction values with which the respective B values of the input image data are corrected based on the third brightness distribution. It is not necessary to correct correction values with which the respective R values and the G values of the input image data are corrected based on the third brightness distribution. Then, the image processing unit 6 corrects the respective RGB values of the input image data using the determined correction values.

With the above two types of methods using the third information, it is also possible to obtain desired brightness (for example, brightness represented by the input image data) as display brightness (screen brightness) and reduce color display unevenness as in the case of the above first processing.

<Other Embodiments>

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-019241, filed on Feb. 3, 2016, and Japanese Patent Application No. 2016-246599, filed on Dec. 20, 2016, which are hereby incorporated by reference herein in their entirety.

What is claimed is:

1. An image display apparatus comprising:

a light-emitting unit including a plurality of light sources, each of which emits light having a first color, and a conversion member that converts a part of the light having the first color emitted from the respective light sources into light having a second color and emits light including the light having the first color and the light having the second color;

a display unit configured to display an image on a screen by modulating, based on image data, the light including the light having the first color and the light having the second color emitted from the light-emitting unit;

a control unit configured to individually control respective light-emitting brightness of the plurality of light sources based on input image data;

an estimation unit configured to estimate, based on the respective light-emitting brightness of the plurality of light sources, a first brightness distribution which is a brightness distribution of combined light obtained by combining the light having the first color emitted from the light-emitting unit and a second brightness distribution which is a brightness distribution of combined light obtained by combining the light having the second color emitted from the light-emitting unit; and an image processing unit configured to perform image processing, in which color unevenness in the screen due to a difference between the first brightness distribution and the second brightness distribution is reduced based on the first brightness distribution and the second brightness distribution, to the input image data, and to output image data to which the image processing having been performed to the display unit, wherein respective pixel values of the input image data include a first gradation value corresponding to the first color and a second gradation value corresponding to the second color, and in the image processing, the respective first gradation values of the input image data are corrected based on the first brightness distribution and the respective second gradation values of the input image data are corrected based on the second brightness distribution.

2. The image display apparatus according to claim 1, wherein the conversion member contains quantum dots that convert the light having the first color into the light having the second color.

3. The image display apparatus according to claim 1, wherein a main wavelength of the light having the second color is longer than a main wavelength of the light having the first color.

4. The image display apparatus according to claim 1, wherein the first color is blue, and the second color is red or green.

5. The image display apparatus according to claim 1, wherein the conversion member converts a part of the light having the first color emitted from the respective light sources into light having a third color different from the second color and emits light including the light having the first color, the light having the second color, and the light having the third color, the display unit displays the image on the screen by modulating, based on the image data, the light including the light having the first color, the light having the second color, and the light having the third color emitted from the light-emitting unit, and the estimation unit estimates, based on the respective light-emitting brightness of the plurality of light sources, the first brightness distribution and the second brightness distribution which is the brightness distribution of the combined light obtained by combining the light having the second color emitted from the light-emitting unit and is a brightness distribution of combined light obtained by combining the light having the third color emitted from the light-emitting unit.

6. The image display apparatus according to claim 5, wherein a main wavelength of the light having the third color is longer than a main wavelength of the light having the first color.

7. The image display apparatus according to claim 5, wherein the first color is blue, the second color is red, and the third color is green.

8. The image display apparatus according to claim 1, wherein a first reference distribution which is a brightness distribution of the light having the first color emitted from the light-emitting unit in a case where the light-emitting brightness of the light source is controlled to predetermined light-emitting brightness, and a second reference distribution which is a brightness distribution of the light having the second color emitted from the light-emitting unit in a case where the light-emitting brightness of the light source is controlled to the predetermined light-emitting brightness, are set in advance for the light source, and the estimation unit estimates the first brightness distribution based on the respective light-emitting brightness, which are determined by the control unit, of the plurality of light sources and the first reference distribution, and estimates the second brightness distribution based on the respective light-emitting brightness, which are determined by the control unit, of the plurality of light sources and the second reference distribution.

9. The image display apparatus according to claim 8, wherein the estimation unit estimates, for each of the plurality of light sources, a first partial distribution which is the brightness distribution of the light having the first color emitted from the light-emitting unit in a case where the light-emitting brightness of the light source is controlled to light-emitting brightness determined by the control unit, based on the light-emitting brightness determined by the control unit for the light source and the first reference distribution, estimates, for each of the plurality of light sources, a second partial distribution which is the brightness distribution of the light having the second color emitted from the light-emitting unit in a case where the light-emitting brightness of the light source is controlled to the light-emitting brightness determined by the control unit, based on the light-emitting brightness determined by the control unit for the light source and the second reference distribution, estimates the first brightness distribution by combining the respective first partial distributions of the plurality of light sources, and estimates the second brightness distribution by combining the respective second partial distributions of the plurality of light sources.

10. The image display apparatus according to claim 1, wherein respective pixel values of the input image data include a first gradation value corresponding to the first color and a second gradation value corresponding to the second color, and in the image processing, the respective first gradation values of the input image data are corrected based on the first brightness distribution and the second brightness distribution and the respective second gradation values of the input image data are corrected based on the first brightness distribution and the second brightness distribution.

11. A method for controlling an image display apparatus having:

a light-emitting unit including a plurality of light sources, each of which emits light having a first color, and a conversion member that converts a part of the light having the first color emitted from the respective light sources into light having a second color and emits light including the light having the first color and the light having the second color; and a display unit configured to display an image on a screen by modulating, based on image data, the light including the light having the first color and the light having the second color emitted from the light-emitting unit, the method comprising:

a control step of individually controlling respective light-emitting brightness of the plurality of light sources based on input image data;

an estimation step of estimating, based on the respective light-emitting brightness of the plurality of light sources, a first brightness distribution which is a brightness distribution of combined light obtained by combining the light having the first color emitted from the light-emitting unit and a second brightness distribution which is a brightness distribution of combined light obtained by combining the light having the second color emitted from the light-emitting unit; and an image processing step performing image processing, in which color unevenness in the screen due to a difference between the first brightness distribution and the second brightness distribution is reduced based on the first brightness distribution and the second brightness distribution, to the input image data, and outputting image data to which the image processing having been performed to the display unit, wherein respective pixel values of the input image data include a first gradation value corresponding to the first color and a second gradation value corresponding to the second color, and in the image processing, the respective first gradation values of the input image data are corrected based on the first brightness distribution and the respective second gradation values of the input image data are corrected based on the second brie h ness distribution.

12. A non-transitory computer readable medium that stores a program, wherein the program causes a computer to execute a method for controlling an image display apparatus having:

a light-emitting unit including a plurality of light sources, each of which emits light having a first color, and a conversion member that converts a part of the light having the first color emitted from the respective light sources into light having a second color and emits light including the light having the first color and the light having the second color; and a display unit configured to display an image on a screen by modulating, based on image data, the light including the light having the first color and the light having the second color emitted from the light-emitting unit, and the method includes:

a control step of individually controlling respective light-emitting brightness of the plurality of light sources based on input image data;

an estimation step of estimating, based on the respective light-emitting brightness of the plurality of light sources, a first brightness distribution which is a brightness distribution of combined light obtained by combining the light having the first color emitted from the light-emitting unit and a second brightness distribution which is a brightness distribution of combined light obtained by combining the light having the second color emitted from the light-emitting unit; and an image processing step performing image processing, in which color unevenness in the screen due to a difference between the first brightness distribution and the second brightness distribution is reduced based on the first brightness distribution and the second brightness distribution, to the input image data, and outputting image data to which the image processing having been performed to the display unit, wherein respective pixel values of the input image data include a first gradation value corresponding to the first color and a second gradation value corresponding to the second color, and in the image processing, the respective first gradation values of the input image data are corrected based on the first brightness distribution and the respective second gradation values of the input image data are corrected based on the second brightness distribution.

13. An image display apparatus comprising:

a light-emitting unit including a plurality of light sources, each of which emits light having a first color, and a conversion member that converts a part of the light having the first color emitted from the respective light sources into light having a second color and emits light including the light having the first color and the light having the second color;

a display unit configured to display an image on a screen by modulating, based on image data, the light including the light having the first color and the light having the second color emitted from the light-emitting unit;

a control unit configured to individually control respective light-emitting brightness of the plurality of light sources based on input image data;

an estimation unit configured to estimate, based on the respective light-emitting brightness of the plurality of light sources, a first brightness distribution which is a brightness distribution of the light having the first color emitted from the light-emitting unit, and a third brightness distribution which is a difference between the first brightness distribution and a second brightness distribution which is a brightness distribution of the light having the second color emitted from the light-emitting unit; and an image processing unit configured to perform image processing, in which color unevenness in the screen due to a difference between the first brightness distribution and the second brightness distribution is reduced based on the first brightness distribution and the third brightness distribution, to the input image data, and to output image data to which the image processing having been performed to the display unit.

14. An image display apparatus comprising:

a light-emitting unit including a plurality of light sources, each of which emits light having a first color, and a conversion member that converts a part of the light having the first color emitted from the respective light sources into light having a second color and emits light including the light having the first color and the light having the second color;

a display unit configured to display an image on a screen by modulating, based on image data, the light including the light having the first color and the light having the second color emitted from the light-emitting unit;

a control unit configured to individually control respective light-emitting brightness of the plurality of light sources based on input image data; and an image processing unit configured to perform image processing in which color unevenness in the screen due to a difference in brightness ratio of the light having the first color to the light having the second color between a vicinity of a first light source and a vicinity of a second light source is reduced in a case where light-emitting brightness of the first light source and light-emitting brightness of the second light source are different from each other, to the input image data, and to output image data to which the image processing having been performed to the display unit.

15. The image display apparatus according to claim 14, wherein the conversion member contains quantum dots that convert the light having the first color into the light having the second color.

16. The image display apparatus according to claim 14, wherein a main wavelength of the light having the second color is longer than a main wavelength of the light having the first color.

17. The image display apparatus according to claim 14, wherein the first color is blue, and the second color is red or green.

18. The image display apparatus according to claim 14, wherein the conversion member converts a part of the light having the first color emitted from the respective light sources into light having a third color different from the second color and emits light including the light having the first color, the light having the second color, and the light having the third color, the display unit displays the image on the screen by modulating, based on the image data, the light including the light having the first color, the light having the second color, and the light having the third color emitted from the light-emitting unit.

19. The image display apparatus according to claim 18, wherein a main wavelength of the light having the third color is longer than a main wavelength of the light having the first color.

20. The image display apparatus according to claim 18, wherein the first color is blue, the second color is red, and the third color is green.

* * * * *